US006651392B2

(12) United States Patent
Ritzal

(10) Patent No.: US 6,651,392 B2
(45) Date of Patent: Nov. 25, 2003

(54) PORTABLE MOTOR-VEHICLE WORKSHOP

(75) Inventor: Harald Ritzal, Wiener Neustadt (AT)

(73) Assignee: Riri Privatstiftung, Wiener Neustadt (AT)

( * ) Notice: Subject to any disclaimer, the term of this patent is extended or adjusted under 35 U.S.C. 154(b) by 0 days.

(21) Appl. No.: 10/107,089

(22) Filed: Mar. 26, 2002

(65) Prior Publication Data

US 2002/0139057 A1 Oct. 3, 2002

(30) Foreign Application Priority Data

Mar. 27, 2001 (AT) ..... 336/2001 U

(51) Int. Cl.[7] ..... E04H 1/00

(52) U.S. Cl. ..... 52/36.2; 52/36.1; 52/79.1; 52/143; 296/17; 296/24.1; 296/26; 296/61; 296/158; 296/168; 296/181; 280/400; 280/423; 280/504.1

(58) Field of Search ..... 52/36.1, 79.1, 52/143, 36.2; 280/400, 423.1, 504; 296/24.1, 26, 57.1, 61, 181, 17, 168, 158

(56) References Cited

U.S. PATENT DOCUMENTS 3,308,845 A * 3/1967 Bellas et al. ..... 137/234.6
3,845,980 A * 11/1974 Grabast ..... 296/168
3,913,934 A * 10/1975 Koehn et al. ..... 280/656
3,931,895 A * 1/1976 Grimaldo ..... 414/678
4,031,982 A * 6/1977 Lindfors ..... 29/281.5
4,119,224 A * 10/1978 Moody ..... 414/537
4,394,877 A * 7/1983 Whyte ..... 141/98
4,505,508 A * 3/1985 Carter et al. ..... 296/39.2
4,659,132 A * 4/1987 Day ..... 296/24.1
4,669,775 A * 6/1987 Mathers ..... 296/141
4,724,875 A * 2/1988 Baldwin et al. ..... 141/98
4,872,419 A * 10/1989 Blankemeyer et al. ..... 118/713
4,901,980 A * 2/1990 Hansen ..... 254/9 C
4,981,318 A * 1/1991 Doane et al. ..... 296/24.1
5,040,482 A * 8/1991 McGuire et al. ..... 118/326
5,314,200 A * 5/1994 Phillips ..... 280/400
5,340,082 A * 8/1994 Holloway ..... 254/88
5,343,813 A * 9/1994 Septer ..... 105/355
5,354,165 A * 10/1994 Booher ..... 414/498
5,505,581 A * 4/1996 Gearin et al. ..... 414/498
5,548,759 A * 8/1996 Lipe ..... 707/100
5,628,596 A * 5/1997 Halpin et al. ..... 410/29
5,833,294 A * 11/1998 Williams et al. ..... 296/24.1
5,853,215 A * 12/1998 Lowery ..... 296/24.1
5,904,339 A * 5/1999 Flinn ..... 254/88
6,102,370 A * 8/2000 Johnston ..... 254/89 H
6,117,333 A * 9/2000 Frankiewicz et al. ..... 210/705
6,173,941 B1 * 1/2001 Johnston ..... 254/89 H
6,237,720 B1 * 5/2001 Sutton ..... 184/106
6,283,537 B1 * 9/2001 DeVore, III ..... 296/181
6,296,028 B1 * 10/2001 Oakland ..... 141/231
6,325,435 B1 * 12/2001 Dubuc ..... 296/24.1

* cited by examiner

*Primary Examiner*—Carl D. Friedman
*Assistant Examiner*—Christy M. Green
(74) *Attorney, Agent, or Firm*—Herbert Dubno; Andrew Wilford

(57) ABSTRACT

A portable motor-vehicle workshop has a plurality of rigid rectangular I-beam reinforced floor panels, bolts securing the floor panels together to form a planar horizontal floor, and a plurality of portals each having a pair of spaced vertical lower posts having lower ends secured to the floor, respective angled connector beams extending inward and upward at acute angles from upper ends of the lower posts, respective upper posts extending vertically from upper ends of the angled beams, and a horizontal connector beam extending between upper ends of the respective upper posts. A plurality of panels are bolted to the posts and beams of the portals and enclose a space above the floor. A lift on the floor can raise a vehicle up between the upper posts.

4 Claims, 4 Drawing Sheets

PORTABLE MOTOR-VEHICLE WORKSHOP

FIELD OF THE INVENTION

The present invention relates to a motor-vehicle workshop. More particularly this invention concerns such a workshop which is portable.

BACKGROUND OF THE INVENTION

A standard portable car workshop is made using two modules each having the dimensions and shape of a standard shipping container. After the two modules are delivered to the site, each has one of its longitudinal side walls removed to open it up and they are put together with their open sides facing each other to form a large interior area having the volume of the two containers combined. One or both of the containers are normally provided with a roll-up door for entry and egress, and various standard equipment may be deployed in each of them.

While working with such a standardized module makes it easy to handle and ship the unassembled workshop, the resultant structure has several disadvantages. The main one is that it is insufficiently tall to allow the vehicle to be raised on a lift inside the structure so that a worker can get underneath the vehicle being worked on. Furthermore the largely empty structures represent dead freight in that they are large but light, and a major element of each one, that is one full-length longitudinal wall, must be removed at the erection site and stored if the shop is to be disassembled at a later date and shipped off to another location.

OBJECTS OF THE INVENTION

It is therefore an object of the present invention to provide an improved portable motor-vehicle workshop.

Another object is the provision of such an improved portable motor-vehicle workshop which overcomes the above-given disadvantages, that is which can be erected easily, which can accommodate a car raised on a lift, and which takes up very little space when knocked down.

SUMMARY OF THE INVENTION

A portable motor-vehicle workshop has according to the invention a plurality of rigid rectangular I-beam reinforced floor panels, bolts securing the floor panels together to form a planar horizontal floor, and a plurality of portals each having a pair of spaced vertical lower posts having lower ends secured to the floor, respective angled connector beams extending inward and upward at acute angles from upper ends of the lower posts, respective upper posts extending vertically from upper ends of the angled beams, and a horizontal connector beam extending between upper ends of the respective upper posts. A plurality of panels are bolted to the portals and enclose a space above the floor. A lift on the floor can raise a vehicle up between the upper posts.

The wall panels can be made of aluminum and plastic and include transparent portions and/or windows and/or skylights. They rigidify the structure greatly once connected to the portals, producing a very stiff and stable building.

According to the invention end walls are provided at least one of which is provided with a roll-up vehicle door. This roll-up door has a width equal at most to a horizontal spacing between the upper posts of the portals. A standard door can also be provided in the end panel, normally next to the roll-up vehicle door.

Each floor panel in accordance with the invention comprises an annular inwardly open C-section channel, a plurality of parallel I-beams fixed to the channel, a wooden plate secured to the I-beams within the channel, and a wear surface on an outside face of the wooden plate. The wooden plate can be made of oriented-strand board or plywood and can be held underneath one of the flanges of the C-section edge channel. Atop the plywood plates is normally a synthetic-resin covering, preferably with a nubbed surface giving good traction. Normally with 4 cm thick floor plates it is possible to bolt most equipment, for instance a tire-balancing machine, right to the floor, although the vehicle lift itself is normally secured to the I-beams or to plates welded to the I-beams.

At least some of the floor panels according to the invention are formed with an upwardly open trough covered by a grate. A conduit system connected to the trough runs into an oil skimmer outside the workshop connected to the conduit system. Thus any water getting into the portable shop or any liquids draining off or from the vehicles therein can be trapped and conducted out.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
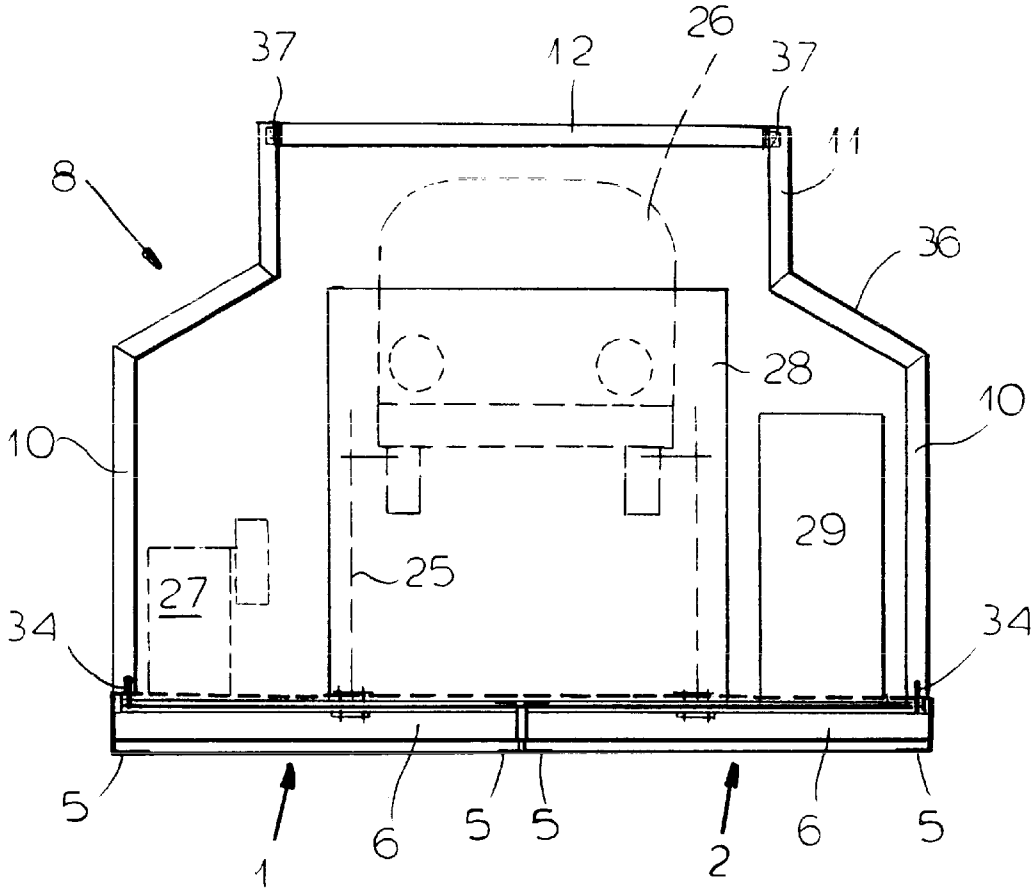
FIG. 1 is a vertical section taken along line I—I through the portable shop according to the invention.
Figure 2:
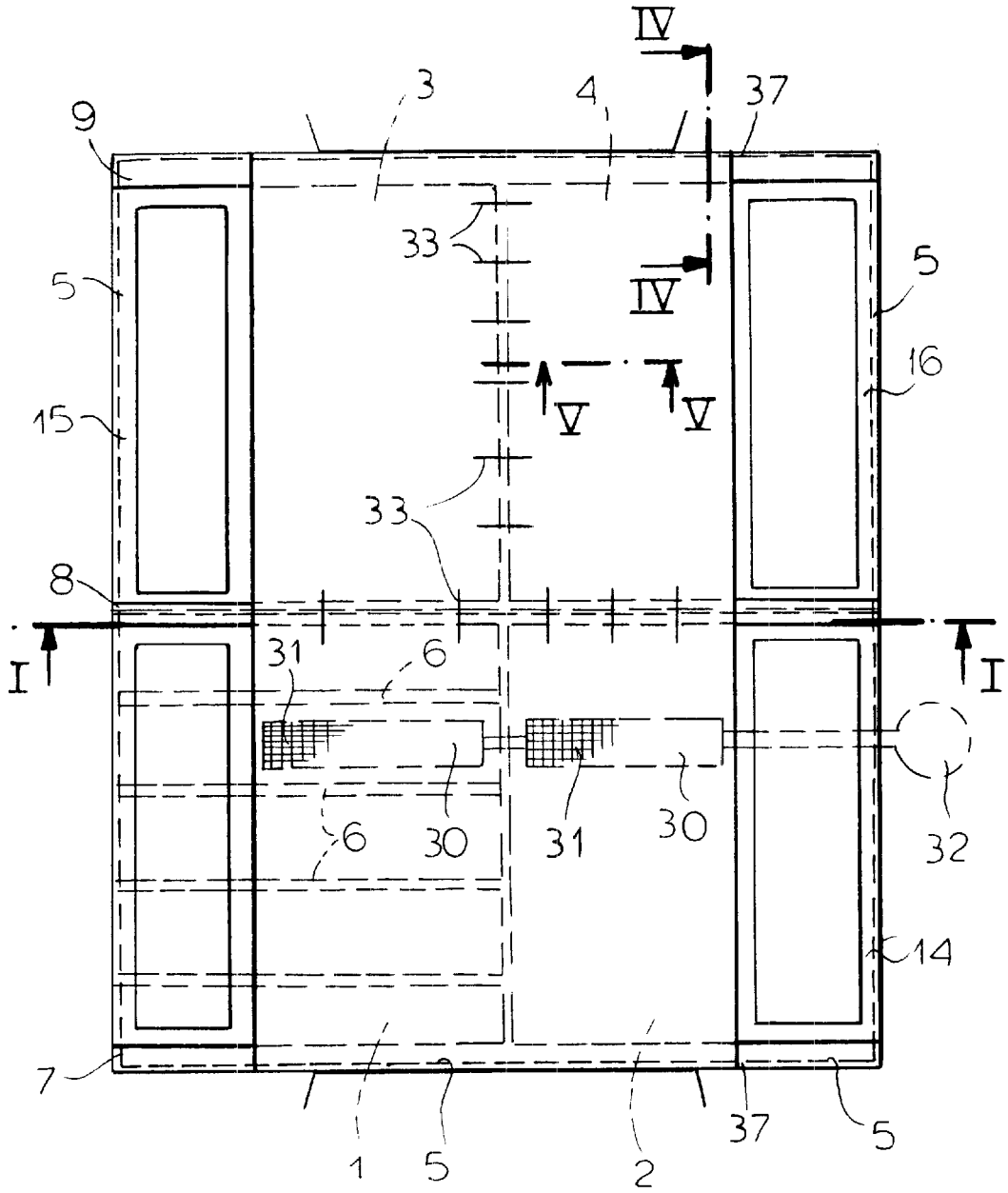
FIGS. 2 and 3 are top and side views taken in the direction of respective arrows II and III of FIG. 1.
Figure 3:
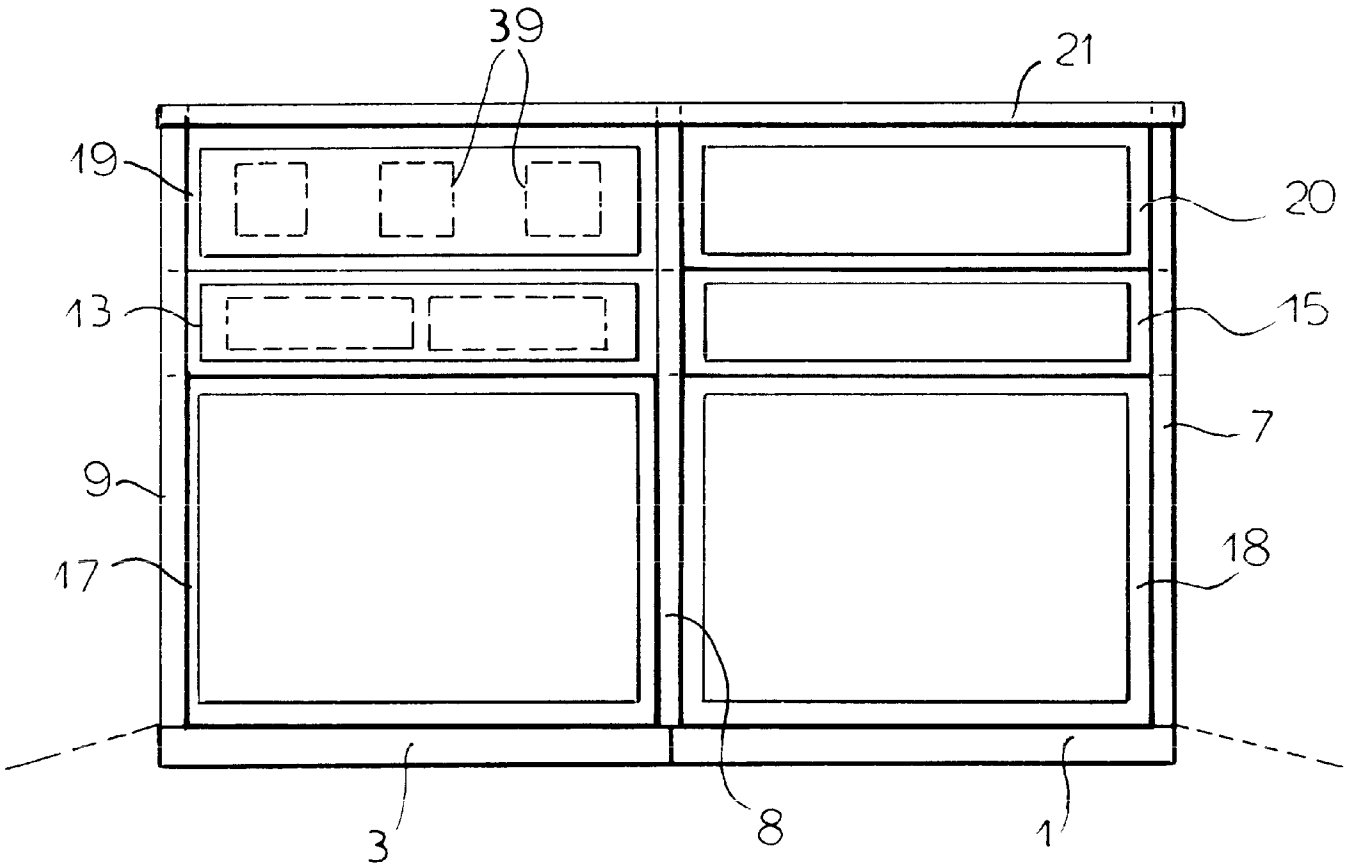

As seen in FIGS. 1 through 3 a portable workshop according to the invention basically comprises four rectangular and rigid floor panels 1, 2, 3, and 4 secured together by bolt fasteners indicated schematically at 33 so as to be coplanar and form a floor. Three identical and downwardly U-shaped portals 7, 8, and 9 span the floor thus formed and are bolted thereto by further fasteners indicated schematically at 34. Each portal comprises a vertical lower post 10, an upper post 11 and an angled connecting beam 36 extending at 45° to the vertical from the upper end of the respective lower post 10 to the lower end of the respective upper post 11. The elements 10, 36, and 11 are of one piece, welded together. The upper end of each upper post 11 is secured by bolts 37 to a horizontal beam 12 forming the top of the respective portal 7, 8, or 9. Each upper post 11 is about one-third the length of the respective lower post 10 and the spacing between the upper posts 11 of each portal 7, 8, or 9 is about the two-thirds spacing between the respective lower posts 10.

Flat insulated panels 17 and 18 are secured between the posts 10 on the long sides of the structure, smaller panels 13, 14, 15, and 16 are secured between the angled beams 36, and further panels 19 and 20 to the upper posts 11. Flat roof panels 21 are secured over the top beams 12 and similar panels 37 are fitted to the ends. A motor-vehicle lift 26 is provided inside the structure for raising a vehicle 26. One of the end panels 37 can have a roll-up garage door 28 and a standard access door 29 for personnel. Inside a wheel-balancing machine 27 is bolted to the panel 1 and the panels 1 and 2 are formed with troughs 30 covered by grates 31 and connected to an oil skimmer 32 outside the structure. The overall height of the structure between the upper posts 11 is sufficient that the vehicle 26 can be raised up far enough for personnel to get completely underneath the vehicle 26. Portions 39 of the panels can be made transparent of formed as windows.

Figure 4:
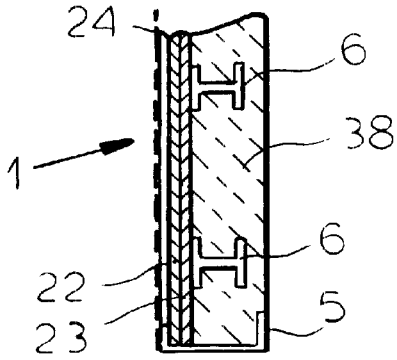
FIGS. 4 and 5 are larger-scale sections taken along lines IV—IV and V—V of FIG. 2.
Figure 5:
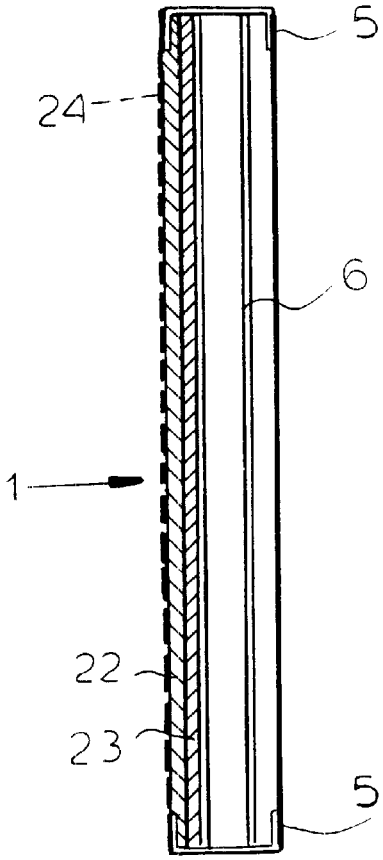

As shown in FIGS. 4 and 5 the panel 1, which is identical to the panels 2, 3, and 4, is comprises of a C-section steel profile beam running around the edges and to which a plurality of longitudinally extending I-beams 6 are welded. Layers of plywood 22 and 23 are provided to one side of the panel 1, covered by a waterproof layer 24. The area between the channels 5 is filled with a rigid mass 38 of insulating foam.

The panels 1 through 4 measure about 3 m by 3.6 m and the beams 6 are spaced at 40 cm from each other. The height to the roof 12 is about 4.3 m so that a 2 m high car can be lifted at least 2 m off the floor surface.

I claim:

1. A portable motor-vehicle work shop comprising:

a plurality of rigid rectangular I-beam reinforced floor panels at least some of which are formed with an upwardly open trough;

respective grates covering the troughs;

a conduit system connected to the trough;

an oil skimmer outside the workshop connected to the conduit system;

bolts securing the floor panels together to form a planar horizontal floor;

a plurality of portals each having a pair of spaced vertical lower posts having lower ends secured to the floor, respective angled connector beams extending inward and upward at acute angles from upper ends of the lower posts, respective upper posts extending vertically from upper ends of the angled beams, and a horizontal connector beam extending between upper ends of the respective upper posts;

a plurality of panels bolted to the posts and beams of the portals and enclosing a space above the floor; and a lift on the floor capable of raising a vehicle up between the upper posts.

2. The portable motor-vehicle workshop defined in claim 1, further comprising end walls at least one of which is provided with a roll-up vehicle door.

3. The portable motor-vehicle workshop defined in claim 2 wherein the roll-up door has a width equal at most to a horizontal spacing between the upper posts of the portals.

4. The portable motor-vehicle workshop defined in claim 1 wherein each floor panel comprises:

an annular inwardly open C-section channel;

a plurality of parallel I-beams fixed to the channel;

a wooden plate secured to the I-beams within the channel; and a wear surface on an outside face of the wooden plate.

* * * * *